US012491448B1

(12) United States Patent
Zhang

(10) Patent No.: US 12,491,448 B1
(45) Date of Patent: Dec. 9, 2025

(54) HOPPING-TYPE AIRCRAFT INTERACTIVE TOY

(71) Applicant: Shenzhen Feifan Chuangke Technology Co., Ltd., Guangdong (CN)

(72) Inventor: Jianye Zhang, Guangdong (CN)

(73) Assignee: Shenzhen Feifan Chuangke Technology Co., Ltd., Guangdong (CN)

( * ) Notice: Subject to any disclaimer, the term of this patent is extended or adjusted under 35 U.S.C. 154(b) by 0 days.

(21) Appl. No.: 19/172,527

(22) Filed: Apr. 7, 2025

(30) Foreign Application Priority Data

Mar. 11, 2025 (CN) ..... 202520414950.2

(51) Int. Cl.
*A63H 27/14* (2006.01)
*A63H 33/22* (2006.01)

(52) U.S. Cl.
CPC ..... *A63H 27/14* (2013.01); *A63H 33/22* (2013.01)

(58) Field of Classification Search
CPC ..... A63H 27/00; A63H 27/12; A63H 27/14
USPC ..... 446/34, 36, 37, 39, 40, 41, 42, 43, 44, 446/45, 46, 47, 48, 55
See application file for complete search history.

(56) References Cited

U.S. PATENT DOCUMENTS 1,462,221 A * 7/1923 Wolfe ..... A63H 1/00 446/39
2,799,120 A * 7/1957 Pitton ..... A63H 1/00 446/43
2,937,473 A * 5/1960 Vlachos ..... A63H 27/12 D21/441
4,202,133 A * 5/1980 Sahar ..... A63H 1/00 446/37
4,233,774 A * 11/1980 Sahar ..... A63H 1/06 446/256
4,453,342 A * 6/1984 Sahar ..... A63H 1/00 446/37
4,480,400 A * 11/1984 diDonato ..... A63H 11/06 446/241
5,827,107 A * 10/1998 Bears ..... A63H 1/20 446/259
7,481,691 B2 * 1/2009 Sze ..... A63H 27/12 446/45
11,766,623 B1 * 9/2023 Chen ..... A63H 33/18 446/46
12,121,826 B2 * 10/2024 Matloff ..... G05D 1/0858
2002/0164921 A1 * 11/2002 Wilkinson ..... A63H 11/06 446/308
2007/0117492 A1 * 5/2007 Sze ..... A63H 27/12 446/57

(Continued)

*Primary Examiner* — Joseph B Baldori
(74) *Attorney, Agent, or Firm* — Hawaii Patent Services; Nathaniel K. Fedde; Kenton N. Fedde

(57) ABSTRACT

The present disclosure provides a hopping-type aircraft interactive toy, which comprises an aircraft body. The aircraft body is equipped with a hopping assembly and a detection assembly. The hopping assembly can undergo elastic deformation to store and release elastic potential energy. The detection assembly is used to detect the flight state of the aircraft body, as well as the elastic energy storage state and potential energy release state of the hopping assembly. The hopping assembly comprises a bouncing rod and an elastic member, and the bouncing rod has a first end and a second end.

15 Claims, 13 Drawing Sheets

(56) References Cited

U.S. PATENT DOCUMENTS

| | | | | |
|---|---|---|---|---|
| 2012/0231696 | A1* | 9/2012 | Xu | A63H 27/12<br>446/37 |
| 2016/0101368 | A1* | 4/2016 | Rehkemper | A63H 27/12<br>446/58 |
| 2024/0359112 | A1* | 10/2024 | Liao | A63H 27/00 |

* cited by examiner

HOPPING-TYPE AIRCRAFT INTERACTIVE TOY

CROSS-REFERENCE TO RELATED APPLICATIONS

This application claims priority to the Chinese patent application No. 202520414950.2, titled "Hopping-Type Aircraft Interactive Toy", filed on Mar. 11, 2025, the entire content and amendments of which are incorporated herein by reference in its entirety.

TECHNICAL FIELD

The present disclosure relates to the technical field of flying toys, and particularly relates to a hopping-type aircraft interactive toy.

BACKGROUND

With the development of technology and the continuous improvement of people's living standards, the types of electronic toys are becoming more and more abundant, and their functions are becoming more and more powerful. Various related technologies of aerodynamic aircrafts have been widely applied in the field of toys, creating various types of aircrafts.

For example, the Chinese patent with the authorization announcement number CN214714349U discloses an aircraft toy, which comprises a cage-shaped support, a paddle and a motor for driving the paddle to rotate are installed in the cage-shaped support, a rotating shaft of the paddle is vertical, the cage-shaped support is a spherical cage-shaped support, and the spherical cage-shaped support comprises a plurality of longitude frame strips extending in the longitude direction and a plurality of latitude frame strips extending in the latitude direction; the warp frame strips and the weft frame strips are collectively called frame strips; a plurality of annular strip-shaped decoration elements simulating the contour shape of the earth and/or the ocean and/or the country are further arranged, and a buckling structure is arranged between each annular strip-shaped decoration element and the corresponding frame strip.

The aircraft toy in the above patent has some deficiencies. For example, the flight motion attitude of the aircraft toy is single, and the interestingness is not good. At the same time, the aircraft toy lacks interaction with users, resulting in insufficient interactivity and playability of the aircraft toy, which affects the user experience of the aircraft toy. Moreover, the aircraft toy consumes high energy and has a short endurance time. Especially when the aircraft makes different motion attitudes, it needs instant high power to cooperate, while the power of traditional aircrafts cannot support them to complete these attitude actions.

Therefore, it is necessary to propose a new type of aircraft toy. This new type of aircraft toy has various flight states, higher interactivity and playability. Moreover, it can also reduce energy consumption and improve the endurance.

SUMMARY

The present disclosure provides a hopping-type aircraft interactive toy to solve the problems raised in the above background art.

In order to achieve the above disclosure object, the present disclosure adopts the following technical solutions:

The present disclosure provides a hopping-type aircraft interactive toy, which includes an aircraft body, wherein the aircraft body is equipped with a hopping assembly and a detection assembly, wherein the hopping assembly is elastically deformable to store and release elastic potential energy, and the detection assembly is configured to detect a flight state of the aircraft body, as well as an elastic energy storage state and a potential energy release state of the hopping assembly; and the hopping assembly comprises a bouncing rod and an elastic member, and the bouncing rod has a first end and a second end, wherein the first end of the bouncing rod penetrates out of the aircraft body and is configured to receive an external force, and drives a relative movement between the bouncing rod and the aircraft body; and at least one end of the elastic member is connected to the bouncing rod, and the elastic member is configured such that when the bouncing rod is subjected to an external force and moves, the elastic member undergoes elastic deformation and stores elastic potential energy.

The present disclosure also provides a hopping-type aircraft interactive toy, which includes an aircraft body, wherein the aircraft body is equipped with a hopping assembly and a detection assembly, wherein the hopping assembly is elastically deformable to store and release to elastic potential energy, and the detection assembly is configured to detect a flight state of the aircraft body, as well as an elastic energy storage state and a potential energy release state of the hopping assembly; and the hopping assembly comprises a bouncing rod and an elastic member, and the bouncing rod has a first end and a second end, wherein the first end of the bouncing rod penetrates out of the aircraft body and is configured to receive an external force, and drives a relative movement between the bouncing rod and the aircraft body; and one end of the elastic member is directly or indirectly connected to the bouncing rod, and the other end is directly or indirectly connected to the aircraft body; and the elastic member is configured such that when the bouncing rod is subjected to an external force and moves, the elastic member is elastically deformed and stores elastic potential energy.

BRIEF DESCRIPTION OF DRAWINGS

The drawings, which form a part of this application, are used to provide a further understanding of the present disclosure. The schematic embodiments of the present disclosure and the descriptions thereof are used to explain the present disclosure and do not constitute an improper limitation of the present disclosure. In the drawings:

FIG. 4 is a schematic structural diagram of FIG. 1 when the elastic member is built-in;

REFERENCE SIGNS

Figure 1:
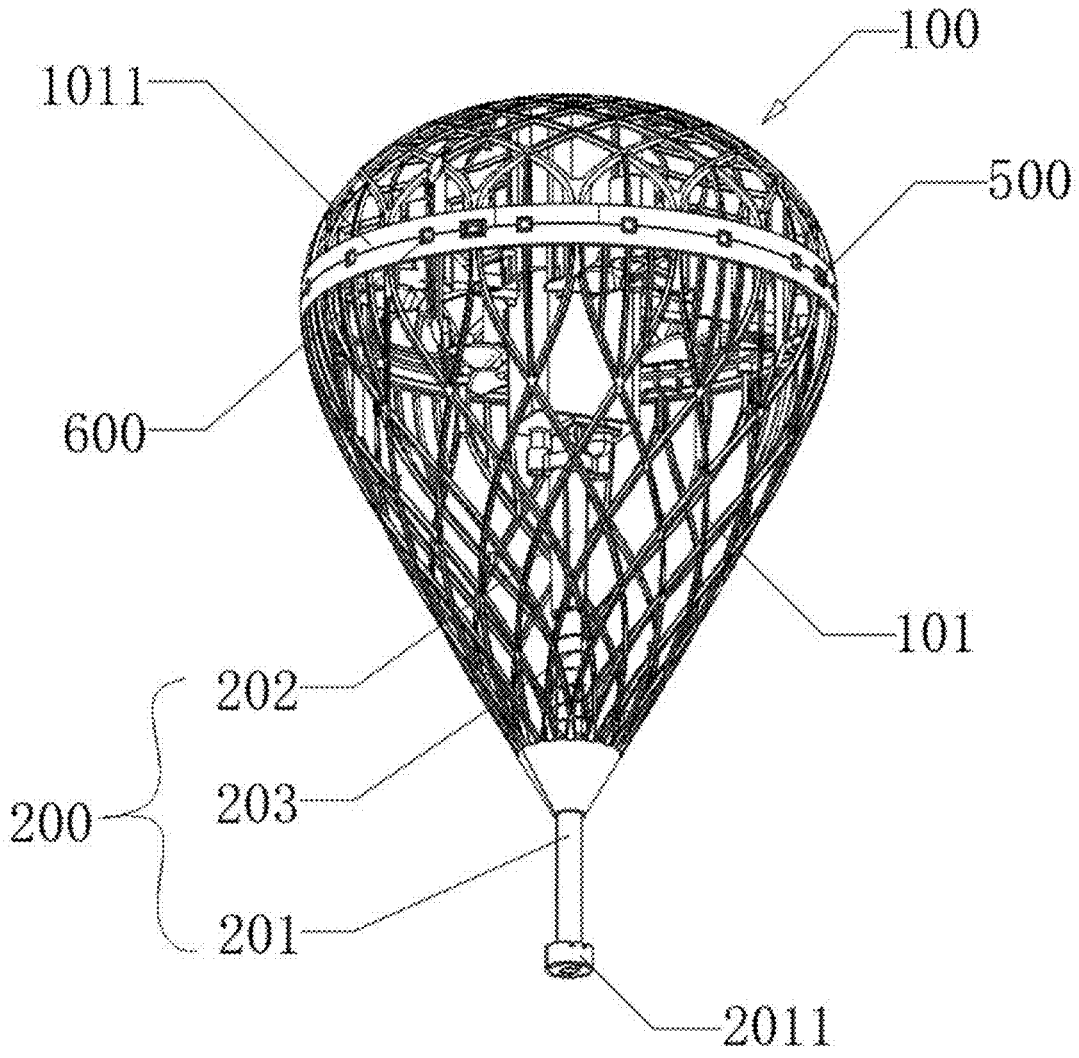
FIG. 1 is a schematic structural diagram of the whole of the present disclosure.

Aircraft body (100); Housing (101); Peripheral frame (1011); accommodating cavity (102); aperture (103); electric motor (104); first rotor component (105); Second rotor component (106); Spindle (107); Reduction gear (108); Hopping assembly (200); Bouncing rod (201); Rod seat (2011); Rod clamp (2012); Elastic member (202); Limiting member (203); Guide groove (2031); Spring retainer (204); Connector (205); Power supply (300); Control board (400); Infrared sensor (500); Light unit (600); Rotor mechanism (700).

DESCRIPTION OF EMBODIMENTS

The technical solution in the embodiment of the present disclosure will be clearly and completely described below with reference to the drawings. Obviously, the described embodiment is part of, rather than all of the embodiments of the present disclosure. The following description of at least one exemplary embodiment is illustrative in nature and is in no way intended to limit the present disclosure, its application or uses. Based on the embodiments in the present disclosure, all other embodiments obtained by those skilled in the art without creative work belong to the scope of protection of the present disclosure.

It should be noted that the terminology used here is only for describing specific embodiments, and is not intended to limit exemplary embodiments according to the present application. As used herein, the singular form is also intended to include the plural form unless the context clearly indicates otherwise. Furthermore, it should be appreciated that when the terms "comprising" and/or "including" are used in this specification, they specify the presence of features, steps, operations, devices, components and/or combinations thereof.

Unless otherwise specified, the relative arrangement of components and steps, numerical expressions and numerical values set forth in these embodiments do not limit the scope of the present disclosure. At the same time, it should be appreciated that for the convenience of description, the dimensions of various parts shown in the drawings are not drawn according to the actual scale relationship. Techniques, methods and equipment known to those skilled in the art may not be discussed in detail, but in appropriate cases, they should be regarded as part of the authorization specification. In all the examples shown and discussed herein, any specific values should be interpreted as illustrative, and not as limiting. Therefore, other examples of exemplary embodiments may have different values. It should be noted that similar numbers and letters indicate similar items in the following drawings, therefore once an item is defined in one drawing, it does not need to be further discussed in subsequent drawings Please refer to FIGS. 1 to 12. The present disclosure provides a hopping-type aircraft interactive toy, which includes an aircraft body. The aircraft body 100 is equipped with a hopping assembly 200 and a detection assembly. The hopping assembly 200 is elastically deformable to store and release elastic potential energy. The detection assembly is used to detect the flight state of the aircraft body 100, as well as the elastic energy storage state and potential energy release state of the hopping assembly 200. The hopping assembly 200 includes a bouncing rod 201 and an elastic member 202. The bouncing rod 201 has a first end and a second end. The first end of the bouncing rod 201 penetrates through the aircraft body 100 and is used to receive an external force, and drives the relative movement between the bouncing rod 201 and the aircraft body 100. At least one end of the elastic member 202 is connected to the bouncing rod 201. The elastic member 202 is configured such that when the bouncing rod 201 is subjected to an external force and moves, the elastic member 202 undergoes elastic deformation and stores elastic potential energy.

According to the above, the aircraft body 100 of the present disclosure further includes a rotor mechanism 700. The aircraft body 100 conducts autonomous flight through the rotor mechanism 700. When the aircraft body 100 is in autonomous flight, if an external force causes the elastic member 202 of the bouncing rod 201 to be in a compressed or stretched state, the hopping assembly 200 will be in a compressed state and store elastic potential energy. Then, when the bouncing rod 201 rebounds and releases the acting force after resetting, it cooperates with the vehicle's own power to increase the lift force, reduce the energy consumption during flight, and obtain instantaneous high power to support the vehicle, enabling the vehicle to make different motion postures, increasing the ornamental and playable value of the flying toy, and also increasing the battery life. Moreover, the user can contact the hopping assembly 200 with body parts to make the hopping assembly 200 in a compressed state and store elastic potential energy. Then, through the cooperation of the bouncing rod 201 and the detection assembly, the aircraft body 100 can make different flight motion postures, greatly increasing the interactivity of the flying toy.

Among them, the elastic energy storage state can be achieved by compressing or stretching the elastic member 202 to deform it, thus presenting an elastic energy storage state. When the external force is removed or becomes invalid, the elastic member 202 resets to a release state. The release state is to convert the potential energy stored in the elastic member 202 into kinetic energy, so that the bouncing rod 201 can quickly pop out to push the obstacle and convert it into the power of the vehicle, thereby reducing the energy consumption of the flying toy during flight, and obtaining instantaneous high power to support the vehicle, enabling the vehicle to make different motion postures, increasing the ornamental and playable value of the flying toy, and also increasing the battery life.

Moreover, the mid-vertical line of the aircraft body 100 of the present disclosure is arranged to coincide with the mid-vertical line of the bouncing rod 201. In this way, the change of the flight motion posture of the aircraft body 100 becomes more stable.

Figure 3:
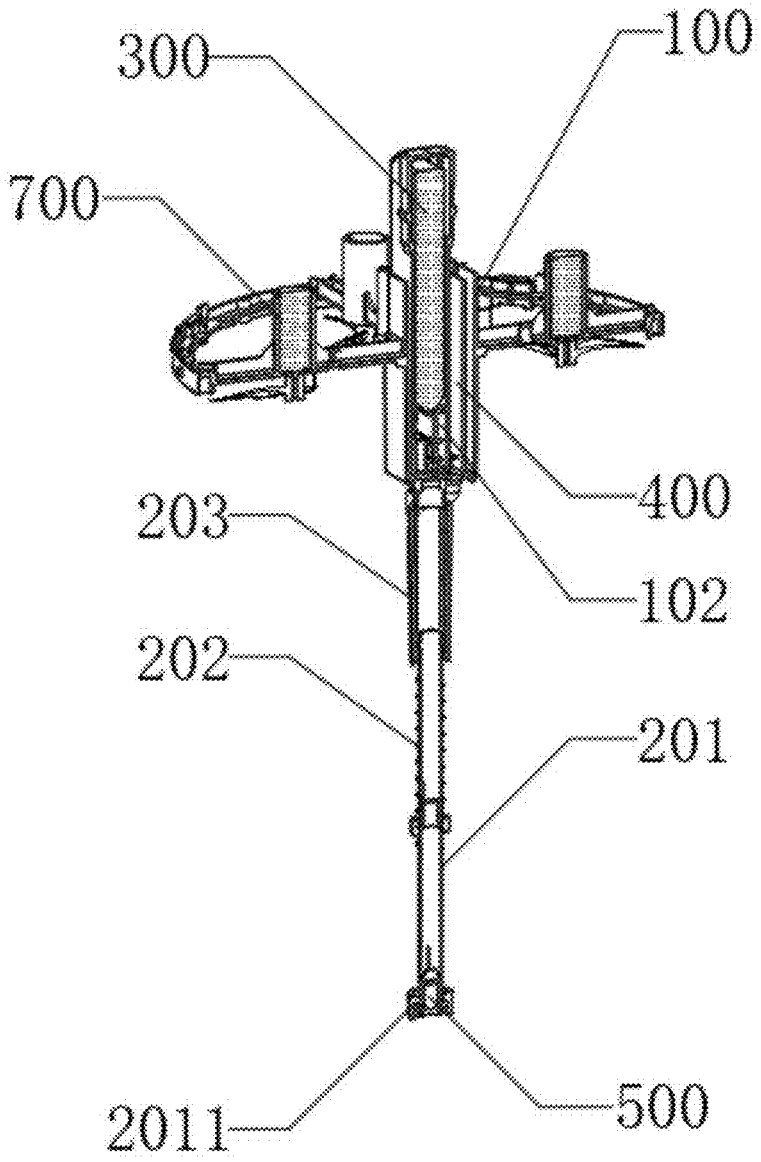
FIG. 3 is a cross-sectional view of FIG. 2.
Figure 5:
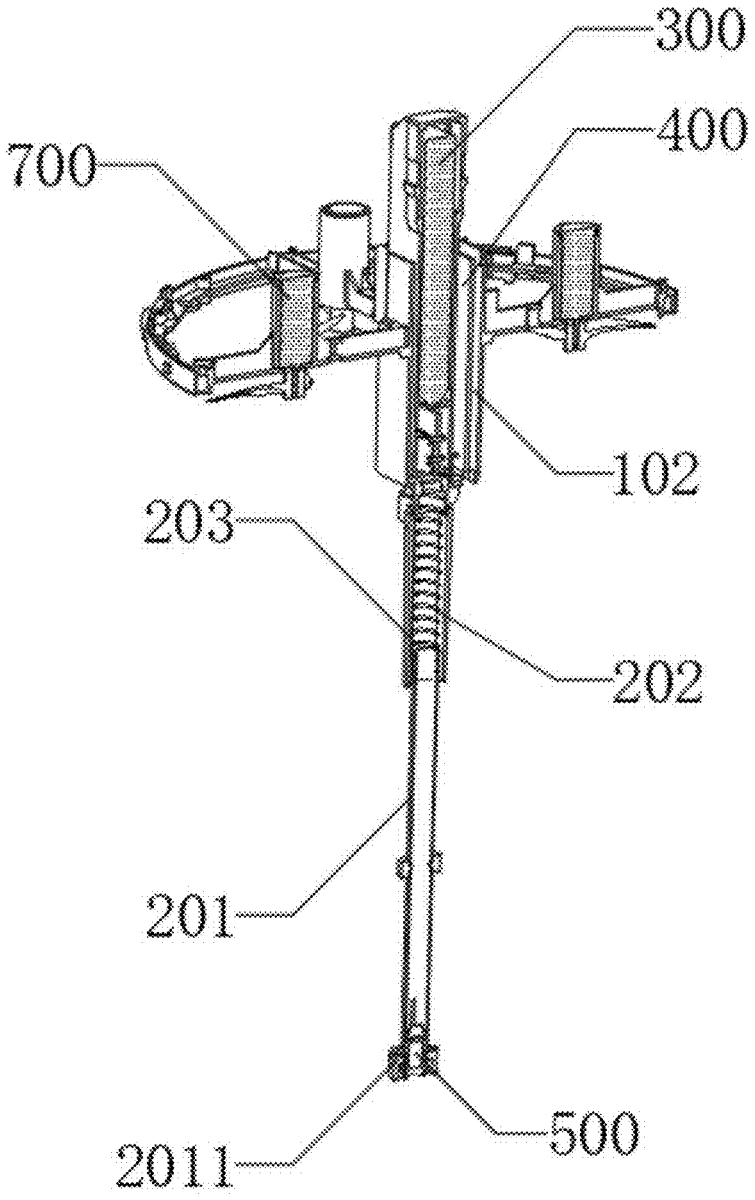
FIG. 5 is a cross-sectional view of FIG. 4 after removing the housing.

In the present disclosure, the aircraft body 100 includes a control board 400. As shown in FIGS. 3 and 5, the detection assembly includes an acceleration sensor. The acceleration sensor is electrically connected to the control board 400. The acceleration sensor is used to detect the acceleration change of the aircraft body 100 and feedback data to the control board 400. Moreover, the acceleration sensor is used to detect the energy storage state of the hopping assembly 200.

In this way, through the preset program of the control board 400, the aircraft body 100 can make different flight motion postures based on the state switching of the hopping assembly 200.

For example, when kicking the rod seat 2011 of the bouncing rod 201, based on the data of various sensors, the control board 400 makes the aircraft body 100 in a hopping state, such as simulating the way of kicking a shuttlecock for entertainment and fitness with the aircraft body 100.

Furthermore, under the control of the control board 400 and in conjunction with the data from various sensors, the aircraft body 100 can perform somersaults and jump in the forward, backward, left, and right directions. This enhances the ornamental and playable qualities of the aircraft toy and also increases its interactivity.

In the present disclosure, the detection assembly includes a gyroscope. The gyroscope is used to detect the flight attitude of the aircraft body 100 and feed back data to the control board 400. The gyroscope monitors the flight attitude of the aircraft body 100, such as detecting the angular velocity of the aircraft body 100.

The detection assembly also includes an accelerometer and a barometer. The accelerometer is used to detect the speed change of the aircraft body 100 and the energy storage state change of the hopping assembly 200. The compression and release states of the hopping assembly 200 detected by the accelerometer are transmitted to the control board 400, enabling the elastic force generated by the hopping assembly 200 to cooperate with the vehicle's own power in real-time to achieve different flight attitude controls. The barometer is used to detect the height change of the aircraft body 100. The rebound force generated by the corresponding hopping assembly 200 can be set according to the descent speed of the aircraft set by the vehicle's height.

The detection assembly also includes an infrared sensor 500. The infrared sensor 500 is installed on the rod seat 2011, as shown in FIGS. 3 and 5. The infrared sensor 500 is used to determine the distance between the rod seat 2011 and an object. In this way, when the aircraft body 100 jumps on its own, the infrared sensor 500 can determine the distance to the ground. When the user interacts with the aircraft body 100, the infrared sensor 500 can determine the distance between the user and the rod seat 2011.

In other embodiments (not shown), the detection assembly further includes an electronic switch, which may be a conventional mechanical switch, magnetic switch, infrared switch, or similar device. The electronic switch is configured to generate switching action when the hopping assembly 200 is compressed or released, thereby sending a switching signal to the control board 400. In this embodiment, the implementation of electronic switches for detection reduces manufacturing and production costs.

Figure 11:
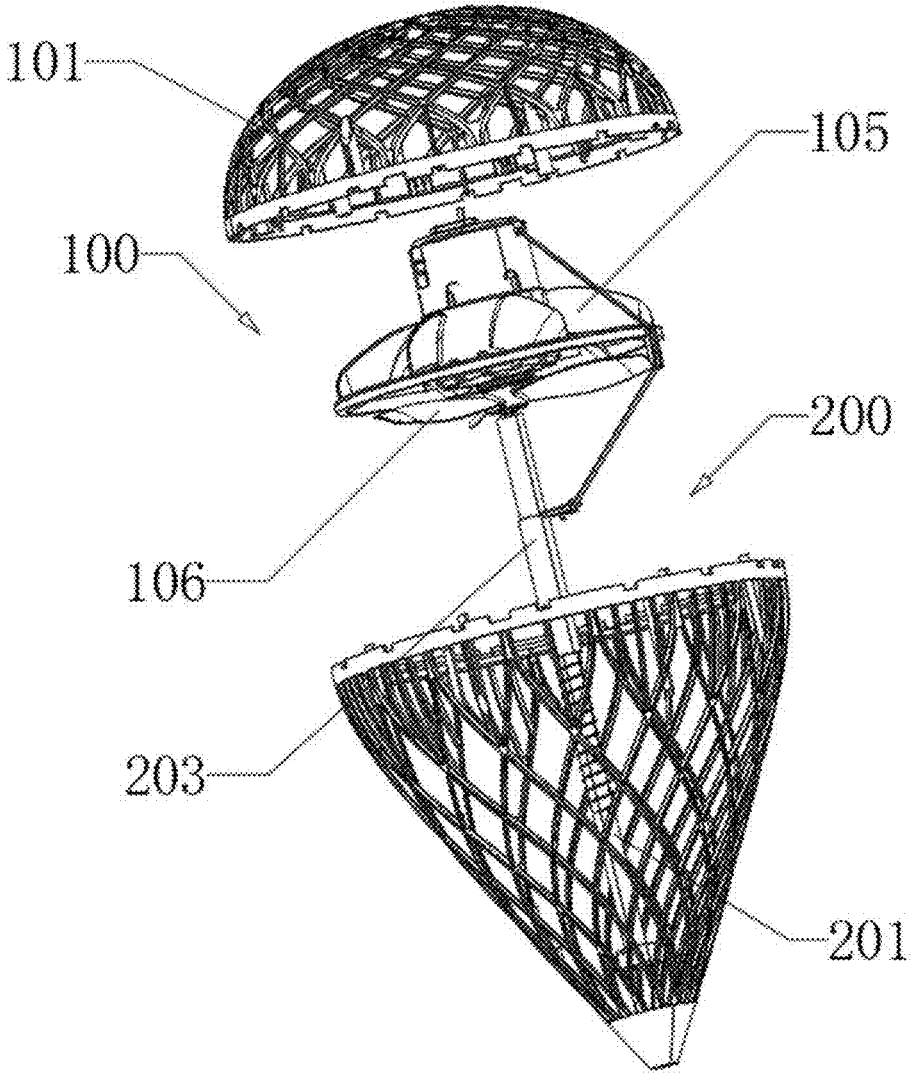
FIG. 11 is a schematic structural diagram of another embodiment of the present disclosure.
Figure 12:
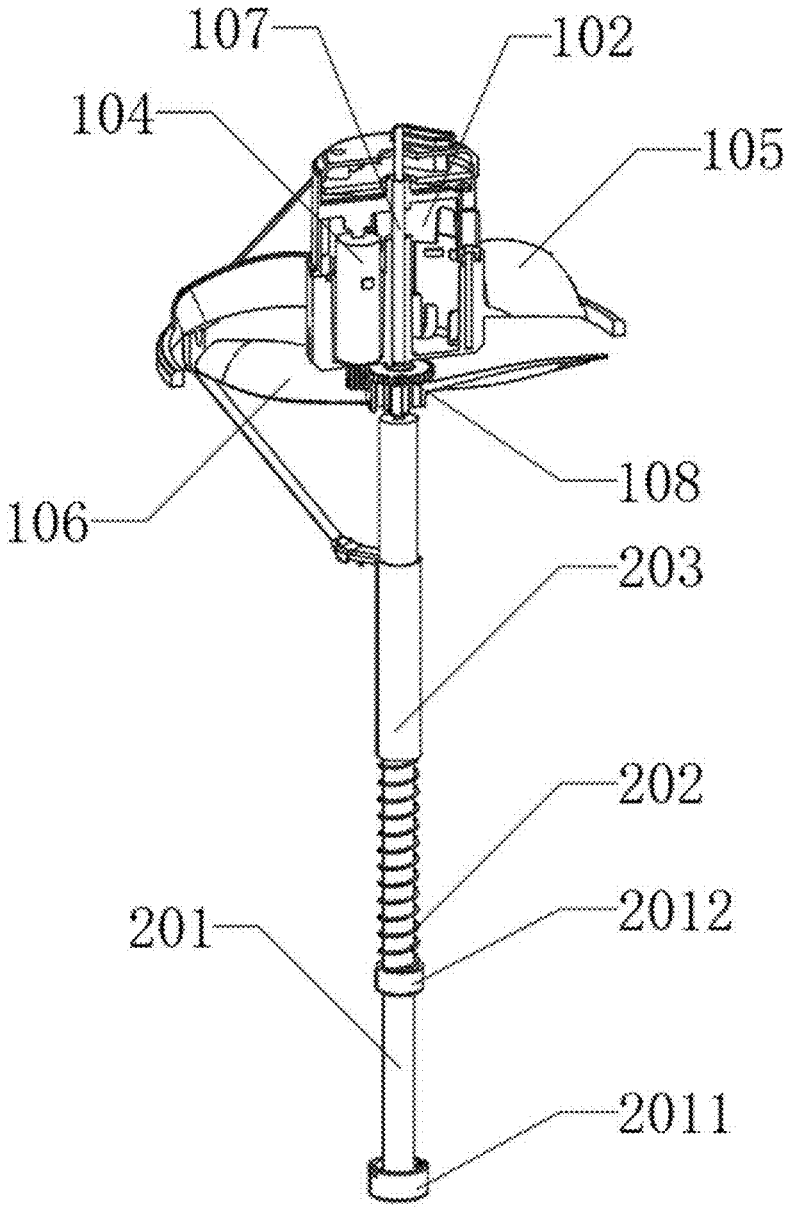
FIG. 12 is a cross-sectional view of FIG. 9 after removing the housing.

In one embodiment of the rotor mechanism 700, as shown in FIGS. 11 and 12, the rotor mechanism 700 includes a housing 101, a spindle 107, an electric motor 104, a first rotor component 105, and a second rotor component 106. The first rotor component 105 and the second rotor component 106 are respectively installed on the spindle 107. The center of the first rotor component 105 has an accommodating cavity 102. The electric motor 104 is installed in the accommodating cavity 102, and the electric motor 104 is fixedly installed with the cavity wall of the accommodating cavity 102. A power supply 300 and a control board 400 are arranged in the accommodating cavity 102. The power supply 300 and the control board 400 are respectively electrically connected to the electric motor 104. The second rotor component 106 is located below the first rotor component 105. The spindle 107 is arranged through the second rotor component 106, and the upper end of the spindle 107 is rotatably installed with the housing 101. The lower end of the spindle 107 is embedded in a limiting member 203, and the limiting member 203 is movably connected to a bouncing rod 201. The electric motor 104 drives the second rotor component 106 to rotate through a reduction gear 108. The first rotor component 105 is in a linkage connection with the second rotor component 106.

When the electric motor 104 is energized, the rotating shaft of the electric motor 104 drives the second rotor component 106 to rotate through the reduction gear 108. The reverse torsion force generated by the rotation of the electric motor 104 drives the first rotor component 105 to rotate. The first rotor component 105 and the second rotor component 106 rotate differentially in opposite directions. Both of them simultaneously generate downward wind to produce the lift force of the aircraft. Moreover, the high-speed rotation of the first rotor component 105 generates a gyroscopic effect, which keeps the flight angle of the aircraft unchanged and realizes self-stable flight.

Furthermore, under the action of the spindle 107, the first rotor component 105 and the second rotor component 106 are differentially arranged respectively.

In other embodiments of the rotor mechanism 700, the rotor mechanism 700 is directly driven by the electric motor 104 to rotate the rotors, and the rotor mechanism 700 is arranged in multiple groups. The multiple groups of rotor mechanisms 700 are evenly distributed in the housing 101, as shown in FIGS. 1 to 6. Thus, the flight of the aircraft body 100 is realized through the multiple groups of rotor mechanisms 700.

In one embodiment, the aircraft body 100 further includes a housing 101 and a light unit 600. The housing 101 has a peripheral frame 1011, and the peripheral frame 1011 is arranged in a ring shape. The light unit 600 is installed on the peripheral frame 1011, and the light unit 600 is used to emit light outward. In this way, under the action of the light unit 600, the atmosphere and ornamental value of the aircraft toy are enhanced.

In one embodiment, the detection assembly includes multiple infrared sensors 500. The infrared sensors 500 are arranged at intervals along the peripheral frame 1011. Each infrared sensor 500 is used to detect the distance between the housing 101 and an object. In this way, with the cooperation of each infrared sensor 500, it assists in detecting the flight attitude of the aircraft body 100. At the same time, it facilitates the rapid feedback of the force situation of the aircraft body 100.

Specifically, the interactive contact between the user and the aircraft body 100 can be achieved by using hands, feet, or body parts to contact the rod seat 2011 to realize bouncing interaction.

The aircraft body 100 has two working states. One is passive compression energy storage. When the aircraft is flying in the air or starts from a stationary state, it is slapped or kicked by a person at the bottom of the bouncing rod 201, which causes the bouncing rod 201 to push the elastic member 202, making the elastic member 202 compressed for energy storage. At this time, the sensors of the aircraft body 100 can detect the strength and angle of the slap or the strength and angle of the kick. The control board 400 can control the aircraft body 100 to make different flight motion postures through the data from the sensors, which increases the interactivity of the toy.

The other is to control the aircraft to descend rapidly. When the rod seat 2011 of the bouncing rod 201 touches the ground, the bouncing rod 201 pushes the elastic member 202, making the elastic member 202 compressed for energy storage. Then, the internal sensors detect the rebound release of the bouncing rod 201. At the same time, the propellers of the aircraft are coordinated to quickly increase the lift of the aircraft, so that the power generated by the aircraft toy and the elastic force released by the rebound of the bouncing rod 201 are superimposed, reducing the energy loss of the aircraft toy. Moreover, it enables the aircraft toy to have instantaneous high power, making the aircraft toy more energy-efficient and powerful, supporting the aircraft to make different motion postures, and increasing the interactivity and ornamental value of the aircraft.

Figure 13:
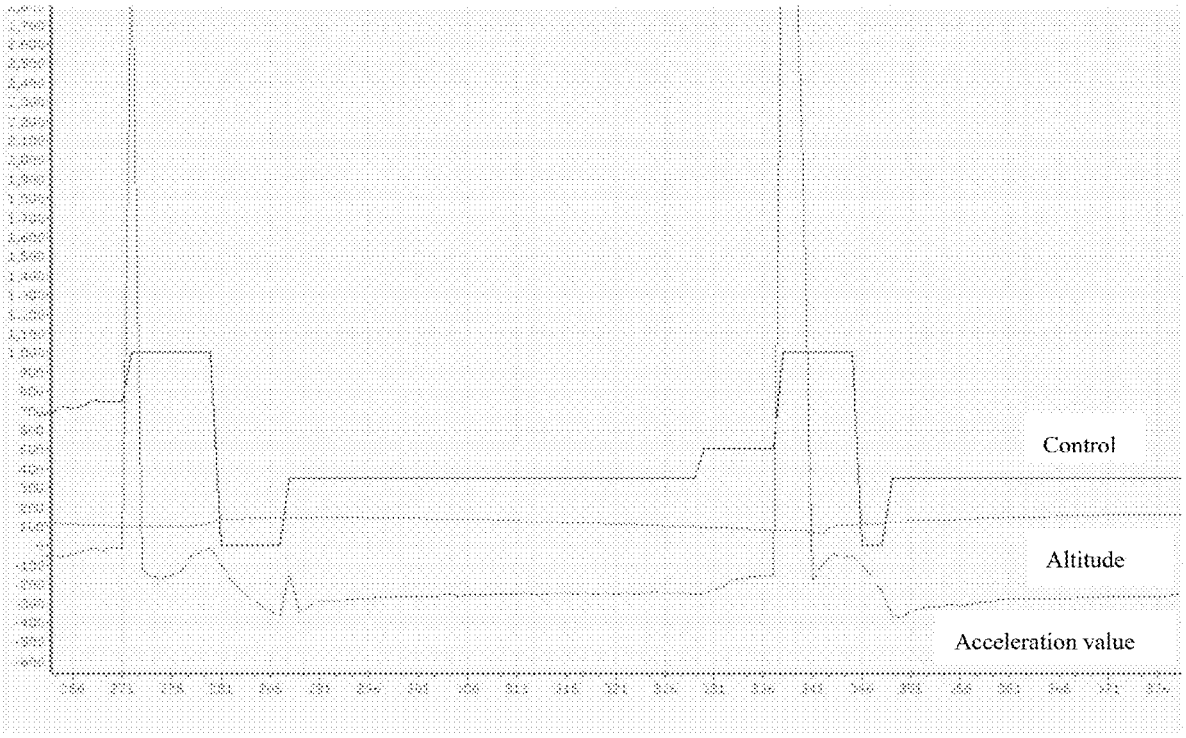
FIG. 13 is a schematic data graph of the cooperation between the accelerometer and the aircraft control of the present disclosure.

As shown in FIG. 13, a control process waveform diagram for controlling the throttle and the height of the aircraft is generated according to the accelerometer values of the detection assembly. The rising edge of the accelerometer waveform represents the compression energy storage process of the hopping assembly 200 under external force, and the falling edge of the waveform is the rebound release process. During the release process, the power throttle value of the aircraft toy itself increases, and the rebound force generated by the hopping assembly 200 is superimposed. The aircraft toy gets instantaneous high-power lift, and the height changes. The corresponding motion process from the falling edge of the accelerometer curve to the numerical change is the rapid bouncing of the aircraft. When the aircraft toy reaches the target height, it starts to descend or hover, entering the next cycle.

Figure 2:
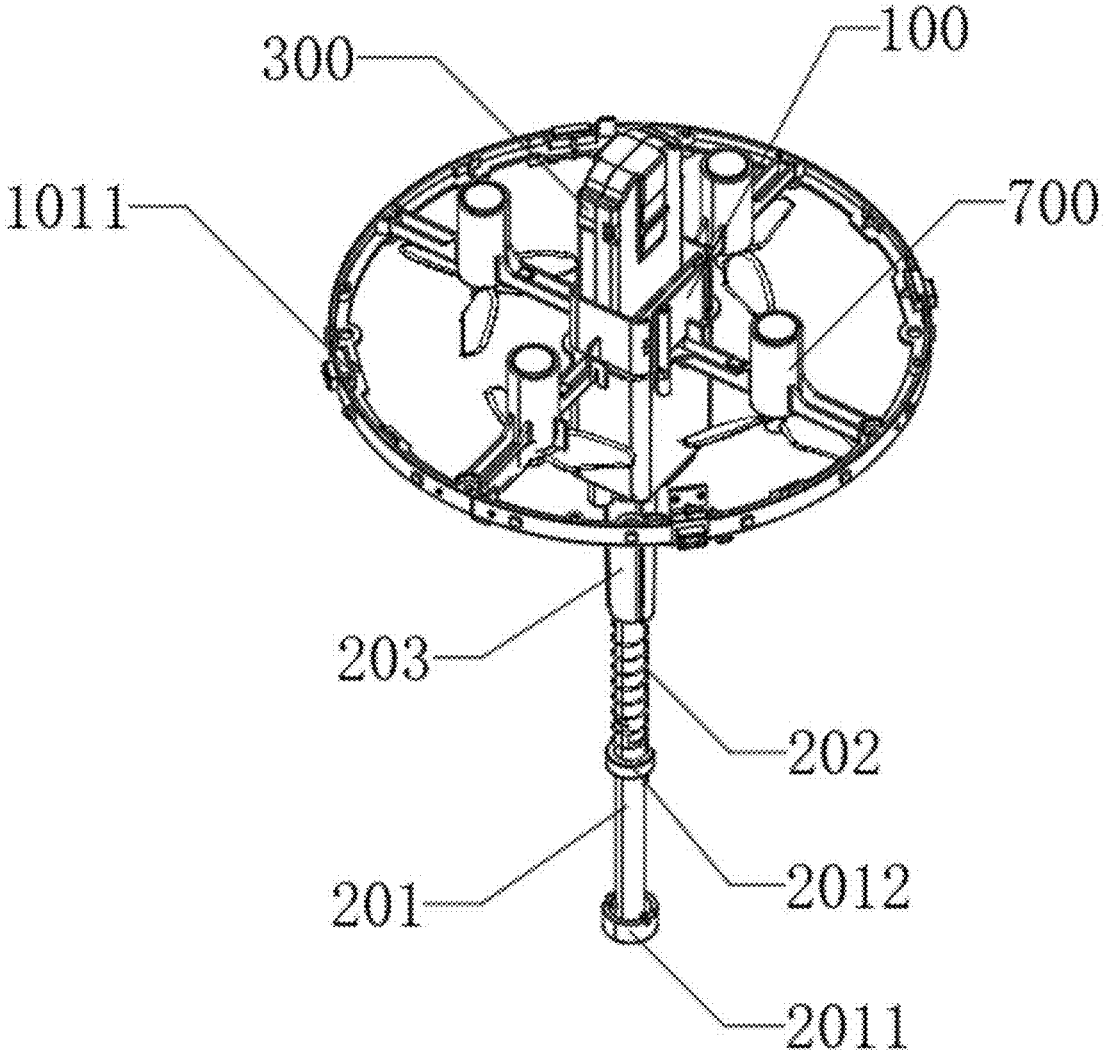
FIG. 2 is a schematic structural diagram of FIG. 1 after removing the housing.

In an embodiment of the hopping assembly 200, as shown in FIGS. 1 to 3, the hopping assembly 200 further includes a limiting member 203 assembled on the aircraft body 100. The second end of the bouncing rod 201 is embedded in the limiting member 203 and is slidably connected to the limiting member 203. The other end of the elastic member 202 is connected to the limiting member 203. The first end of the bouncing rod 201 is configured as a rod seat 2011, and the rod seat 2011 is used to receive an external force. The bouncing rod 201 has a rod clamp 2012, and the elastic member 202 is fixed on the rod clamp 2012. The aircraft body 100 includes a housing 101, and the housing 101 is provided with an aperture 103. The bouncing rod 201 passes through the aperture 103, and the diameter of the rod clamp 2012 is larger than that of the aperture 103 and is located inside the housing 101.

In this embodiment, the limiting member 203 is a sleeve. The bouncing rod 201 is inserted into the limiting member 203 and can slide inside the limiting member 203. Thus, when the rod seat 2011 is subjected to an external force, it pushes the bouncing rod 201 to drive the rod clamp 2012 to compress the elastic member 202 to store potential energy, realizing the switching of the hopping assembly 200 between the extended energy-releasing state and the compressed energy-storing state. Various sensors inside the aircraft detect its flight state and the energy-storing and energy-releasing states of the hopping assembly 200, and then cooperate with the vehicle's own power in real-time to superimpose. This enables the aircraft to obtain instantaneous high power, making the aircraft toy more energy-efficient and powerful, supporting the aircraft to make different motion postures, and increasing the interactivity and ornamental value of the aircraft.

Meanwhile, under the action of the limiting member 203, it plays a role in positioning and limiting the offset of the axial movement of the bouncing rod 201 and the elastic deformation of the elastic member 202, facilitating the state switching of the hopping assembly 200. Under the action of the rod clamp 2012, it positions and limits the movement stroke of the bouncing rod 201 and the elastic change stroke of the elastic member 202, ensuring the movable assembly between the hopping assembly 200 and the aircraft body 100. And by arranging the elastic member 202 externally, the elastic member 202 has a larger axial setting range, meeting the settings of elastic members 202 of different specifications and those with greater elastic force. By making the cross-sectional area of the rod seat 2011 larger than that of the rod body; in this way, the rod seat 2011 has a larger contact area, which is convenient for users to pat or kick the rod seat 2011 of the bouncing rod 201, facilitating the interaction between the user and the aircraft body 100.

In this embodiment, the rod clamp 2012 is annular and fixed on the bouncing rod 201. In other embodiments of the rod clamp 2012 (not shown), the rod clamp 2012 can also be a bolt, a pin shaft or other structures inserted on the bouncing rod 201. And it can also be any other detachable or non-detachable structure protruding from the bouncing rod 201.

In a modified embodiment of this embodiment (not shown), the bouncing rod 201 can also be a hollow rod, and the limiting member 203 is inserted into the bouncing rod 201, so that the bouncing rod 201 can also slide back and forth along the limiting member 203. The elastic member 202 is sleeved outside the limiting member 203, and its two ends are respectively connected to the bouncing rod 201 and the limiting member 203.

In another modified embodiment of this embodiment (not shown), the hopping assembly 200 may not require a limiting member 203. Instead, a chute for the bouncing rod 201 to slide up and down can be provided on the aircraft body 100. The elastic member 202 is sleeved outside the bouncing rod 201, and the two ends of the elastic member 202 are respectively connected to the aircraft body 100 and the bouncing rod 201. Thus, when the bouncing rod 201 moves, it can also ensure that the bouncing rod 201 slides up and down, and the elastic member 202 also produces elastic deformation and stores elastic energy.

Figure 4:
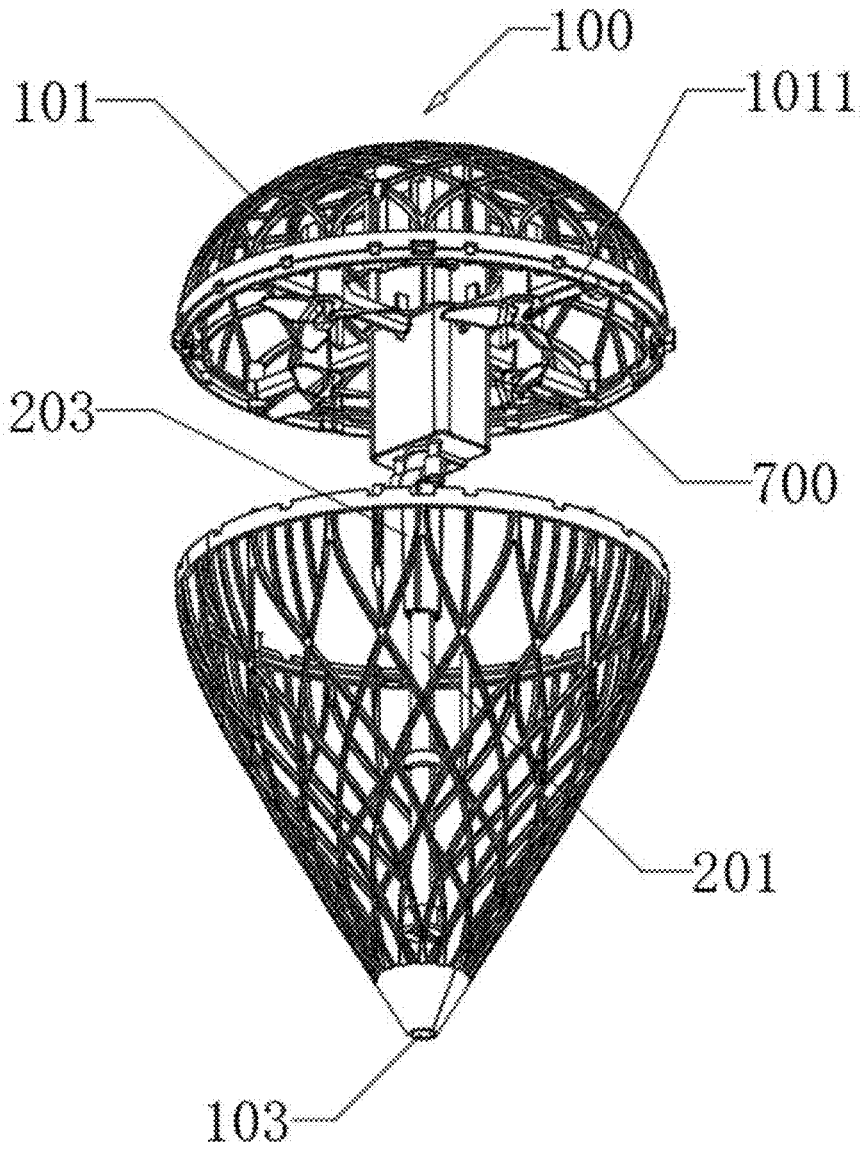

In another embodiment of the hopping assembly 200, as shown in FIGS. 4 and 5, the hopping assembly 200 also includes a limiting member 203 assembled on the aircraft body 100. The second end of the bouncing rod 201 is embedded in the limiting member 203 and is slidably connected to the limiting member 203. The elastic member 202 is located inside the limiting member 203. One end of the elastic member 202 is connected to the second end of the limiting member 203, and the other end is fixed inside the limiting member 203. The bouncing rod 201 has a rod clamp 2012, and the elastic member 202 is fixed on the rod clamp 2012. The aircraft body 100 includes a housing 101, and the housing 101 is provided with an aperture 103. The bouncing rod 201 passes through the aperture 103, and the diameter of the rod clamp 2012 is larger than that of the aperture 103 and is located inside the housing 101.

In this embodiment, the elastic member 202 is arranged internally, which facilitates the elastic deformation of the elastic member 202. Meanwhile, it protects the elastic member 202 and extends its service life. When the rod seat 2011 is subjected to an external force, it pushes the bouncing rod 201 to compress the elastic member 202 and store potential energy, enabling the hopping assembly 200 to switch between the extended energy-releasing state and the compressed energy-storing state. Various sensors inside the aircraft detect its flight state and the energy-storing and energy-releasing states of the hopping assembly 200, and then cooperate with the vehicle's own power in real-time. This allows the aircraft to obtain instantaneous high power, making the aircraft toy more energy-efficient and powerful. It supports the aircraft to make different motion postures, increasing the interactivity and ornamental value of the aircraft.

Meanwhile, under the action of the limiting member 203, it positions the axial movement of the bouncing rod 201 and limits the offset of the elastic deformation of the elastic member 202, facilitating the state switching of the hopping assembly 200. By making the cross-sectional area of the rod seat 2011 larger than that of the rod body, the rod seat 2011 has a larger contact area, which makes it convenient for users to pat or kick the rod seat 2011 of the bouncing rod 201, facilitating the interaction between the user and the aircraft body 100. Under the action of the rod clamp 2012, it positions and limits the moving stroke of the bouncing rod 201, ensuring the movable assembly between the hopping assembly 200 and the aircraft body 100.

In a modified embodiment of this embodiment (not shown), the bouncing rod 201 can be a hollow rod, and the limiting member 203 is inserted into the bouncing rod 201, so that the bouncing rod 201 can also slide back and forth along the limiting member 203. The elastic member 202 is located inside the bouncing rod 201, and its two ends are respectively connected to the bouncing rod 201 and the limiting member 203.

In another modified embodiment of this embodiment (not shown), the hopping assembly 200 may not require the limiting member 203. Instead, a chute for accommodating the up-and-down sliding of the bouncing rod 201 can be opened on the aircraft body 100. The elastic member 202 is installed in the chute, and its two ends are respectively connected to the aircraft body 100 and the bouncing rod 201. Thus, when the bouncing rod 201 moves, it can also ensure that the bouncing rod 201 slides up and down, and the elastic member 202 also undergoes elastic deformation and stores elastic energy.

Figure 6:
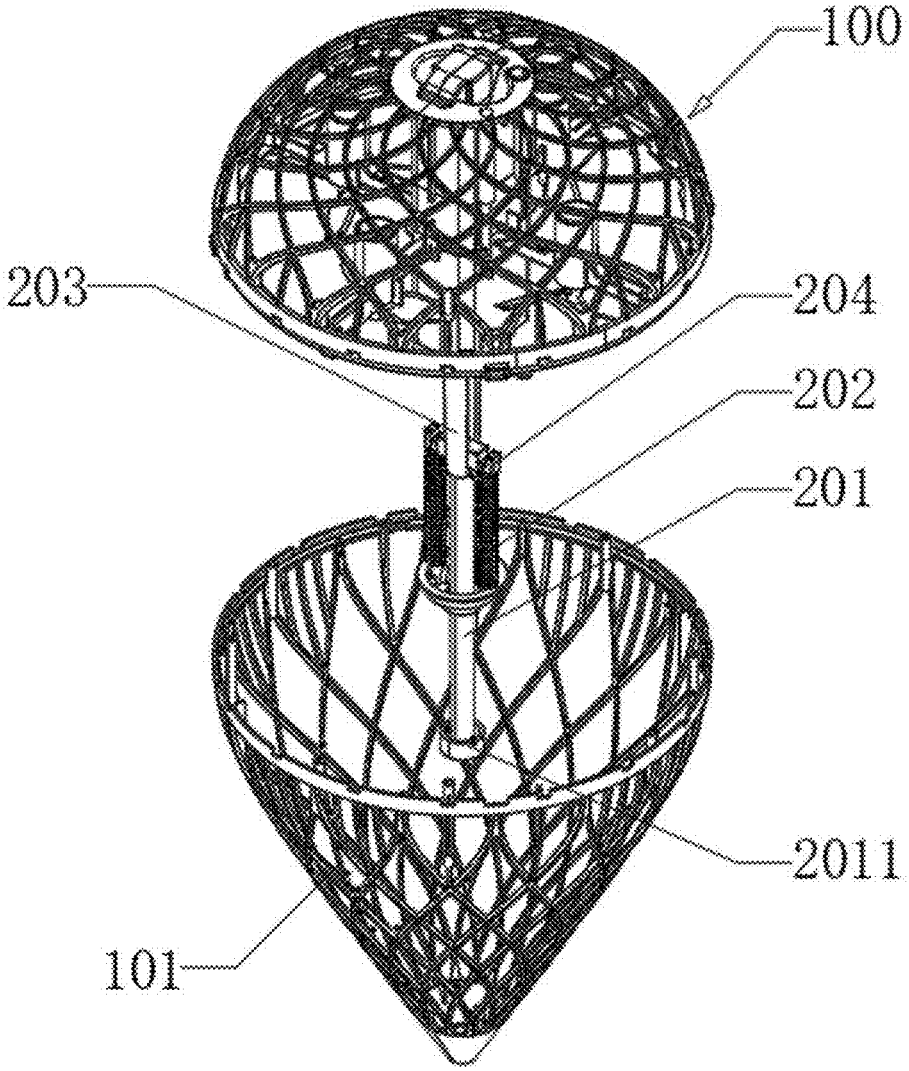
FIG. 6 is a schematic structural diagram of another embodiment of the present disclosure.
Figure 7:
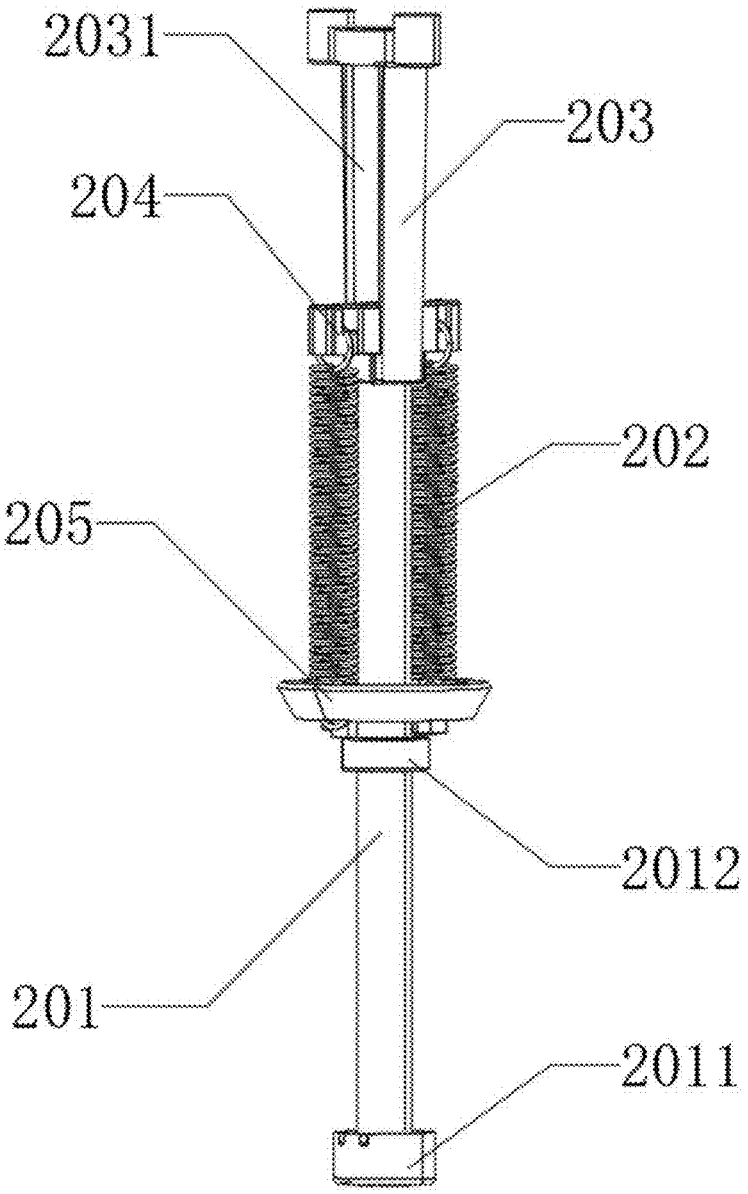
FIG. 7 is a schematic structural diagram of the hopping assembly in FIG. 6.
Figure 8:
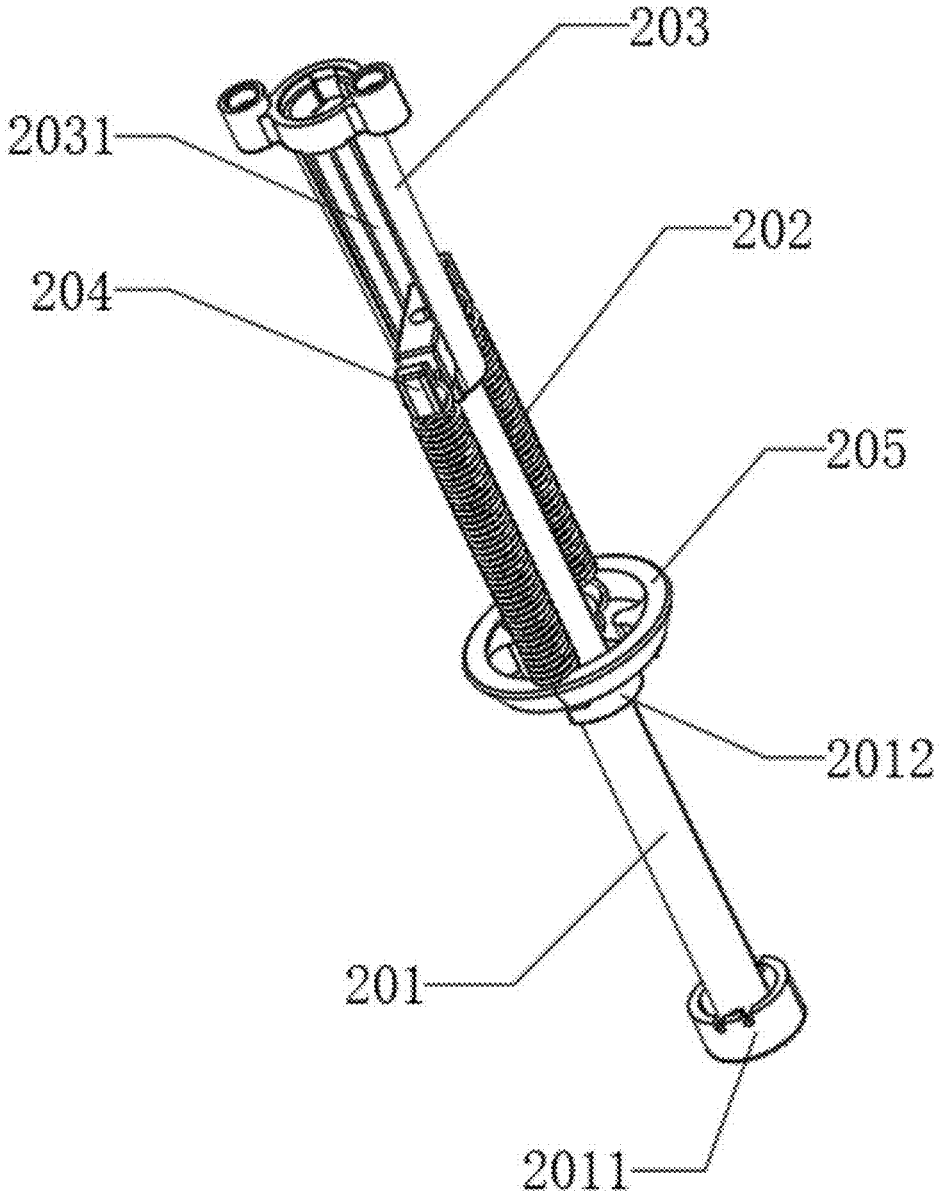
FIG. 8 is a schematic structural diagram of FIG. 7 from another perspective.

In the third embodiment of the hopping assembly 200, as shown in FIGS. 6 to 7, the hopping assembly 200 further includes a limiting member 203 assembled on the aircraft body 100. The second end of the bouncing rod 201 extends towards the limiting member 203 and is equipped with a spring retainer 204. The spring retainer 204 is movably connected to the limiting member 203. One end of the elastic member 202 is connected to the spring retainer 204, and the other end is connected to the aircraft body 100 through a connector 205. When the bouncing rod 201 moves axially under an external force, the bouncing rod 201 drives the spring retainer 204 to move axially and causes the elastic member 202 to be in a stretched state.

In this embodiment, when the bouncing rod 201 is subjected to an external force, the elastic member 202 is in a stretched state, and at this time, it is in an elastic energy-storage state. After the external force is removed, the elastic member 202 resets and pushes the bouncing rod 201 in the reverse direction to be in a released state. That is, the potential energy stored in the elastic member 202 is converted into kinetic energy, so that the bouncing rod 201 is quickly ejected to push the obstacle and convert it into the power of the aircraft.

In this embodiment, two or more elastic members 202 can be provided. Moreover, a guide groove 2031 is formed on the side of the limiting member 203, and the spring retainer 204 is movably embedded in the guide groove 2031. Under the action of the guide groove 2031, it plays a role in positioning and limiting the axial movement of the spring retainer 204, which facilitates the axial movement of the spring retainer 204.

Figure 9:
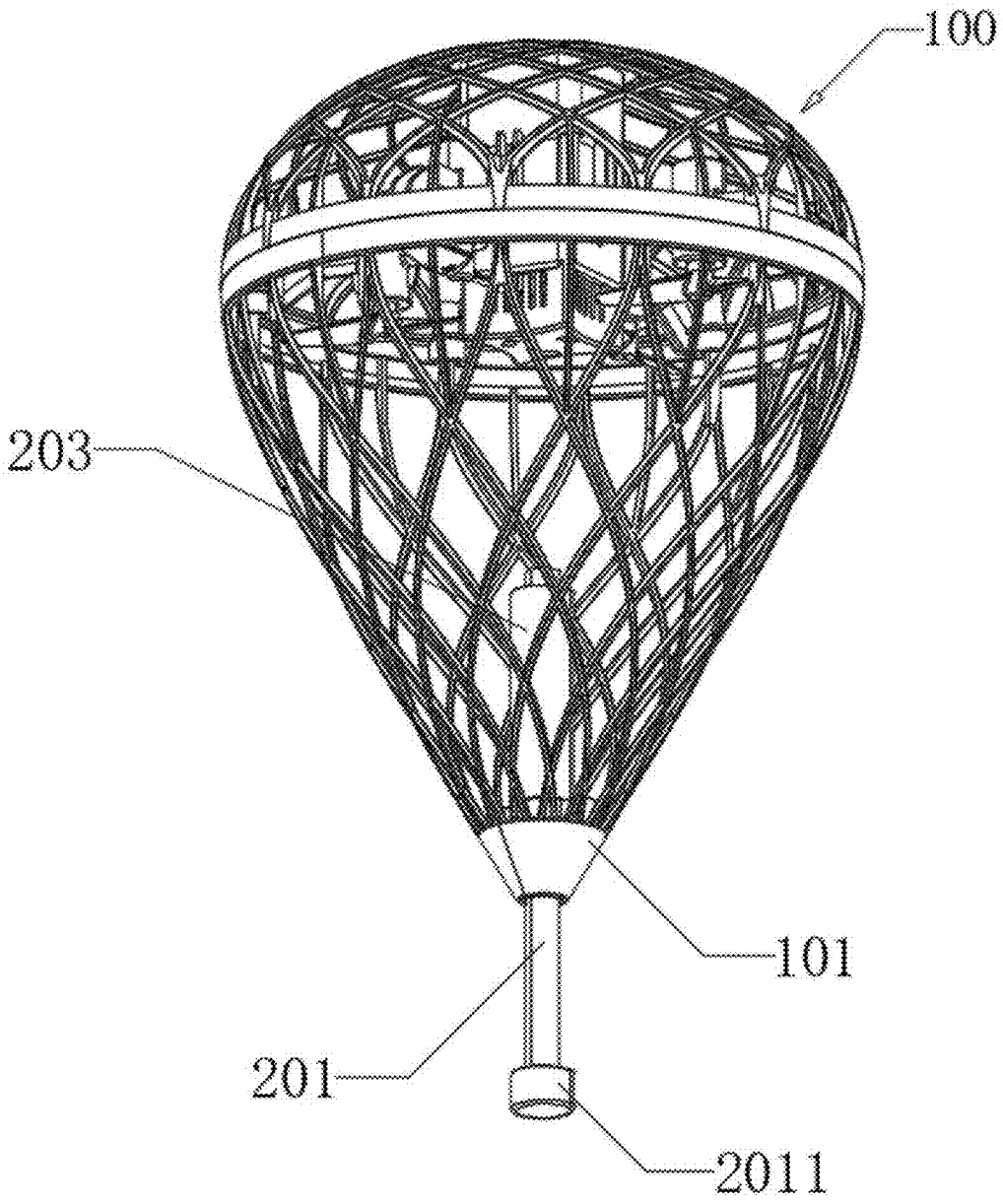
FIG. 9 is a schematic structural diagram of another embodiment of the present disclosure.
Figure 10:
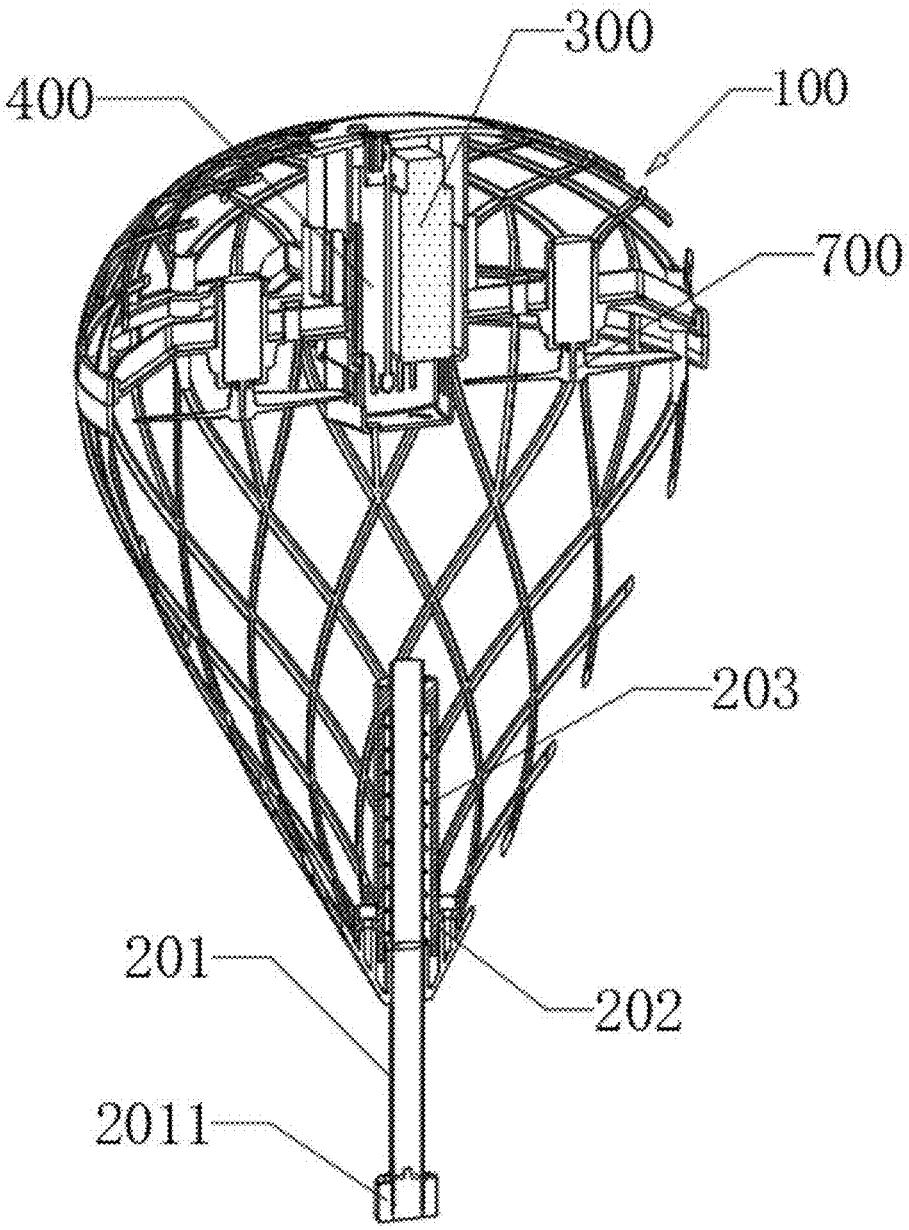
FIG. 10 is a cross-sectional view of FIG. 9.

In the fourth embodiment of the hopping assembly 200, as shown in FIGS. 9 and 10, the limiting member 203 is connected to the housing 101 of the aircraft body 100. The bouncing rod 201 passes through the limiting member 203 and can slide inside the limiting member 203. The elastic member 202 is sleeved on the outside of the bouncing rod 201 and located inside the limiting member 203. At the same time, the two ends of the elastic member 202 are respectively connected to the limiting member 203 and the bouncing rod 201.

In this embodiment, when the bouncing rod 201 moves axially under an external force, the bouncing rod 201 drives the spring retainer 204 to move axially, causing the elastic member 202 to be compressed or stretched, thereby storing elastic energy. After the external force is removed, the elastic member 202 resets and pushes the bouncing rod 201 in the opposite direction to move into a released state. That is, the potential energy stored in the elastic member 202 is converted into kinetic energy, causing the bouncing rod 201 to quickly pop out and push the obstacle, which is converted into the power of the aircraft.

In summary, from the above description, it can be seen that the present disclosure achieves the following technical effects:

In the hopping-type aircraft interactive toy provided by the present disclosure, when the aircraft body 100 is flying autonomously, the bouncing rod 201 is subjected to an external force to compress or stretch the elastic member 202, making the hopping assembly 200 in a compressed energy storage state. Then, when the bouncing rod 201 resets and rebounds to release the acting force, it cooperates with the vehicle's own power to increase the lift, reducing the energy loss during flight. It can also obtain instantaneous large power to support the aircraft, enabling the aircraft to make different movement postures, increasing the ornamental and playable nature of the aircraft, and also increasing the battery life. Moreover, the user contacts the hopping assembly 200 with body parts to make the hopping assembly 200 in a compressed energy storage state. Then, through the cooperation of the bouncing rod 201 and the detection assembly, the aircraft body 100 can make different flight movement postures, greatly increasing the interactivity of the aircraft toy.

In the description of the present disclosure, it should be appreciated that directional terms such as "front, rear, up, down, left, right", "horizontal, vertical, perpendicular, horizontal" and "top, bottom" etc. indicate the orientation or positional relationship based on the orientation or positional relationship shown in the drawings, and are only for the convenience of describing the present disclosure and simplifying the description. In the absence of a contrary explanation, these directional terms do not indicate or imply that the device or element referred to must have a specific orientation or be constructed and operated in a specific orientation, and therefore should not be understood as limiting the scope of protection of the present disclosure; the directional terms "inside, outside" refer to the inside and outside relative to the contour of each component itself.

For the convenience of description, spatial relative terms such as "on . . . ", "above . . . ", "on the upper surface of . . . ", "upper" etc. may be used here to describe the spatial positional relationship of a device or feature with other devices or features as shown in the drawings. It should be appreciated that spatial relative terms are intended to encompass different orientations of the device in use or operation other than the orientation described in the drawings. For example, if the device in the drawing is inverted, the device described as "above other devices or structures" or "on other devices or structures" will subsequently be positioned as "below other devices or structures" or "under other devices or structures". Thus, the exemplary term "above" can include both "above" and "below" orientations. The device can also be positioned in other different ways (rotated 90 degrees or in other orientations), and the spatial relative descriptions used here should be interpreted accordingly.

In addition, it should be noted that the use of terms such as "first", "second" etc. to define components is for the convenience of distinguishing the corresponding components. Unless otherwise stated, the above terms have no special meaning, and therefore should not be understood as limiting the scope of protection of the present disclosure.

The above description is only a preferred embodiment of the present disclosure and is not intended to limit the present disclosure. For those skilled in the art, the present disclosure can have various modifications and changes. Any modifications, equivalent replacements, improvements etc. made within the spirit and principles of the present disclosure should be included within the scope of protection of the present disclosure.

What is claimed is:

1. A hopping-type aircraft interactive toy, comprising an aircraft body, wherein the aircraft body is equipped with a hopping assembly and a detection assembly, wherein the hopping assembly is elastically deformable to store and release elastic potential energy, and the detection assembly is configured to detect a flight state of the aircraft body, as well as an elastic energy storage state and a potential energy release state of the hopping assembly; and the hopping assembly comprises a bouncing rod and an elastic member, and the bouncing rod has a first end and a second end, wherein the first end of the bouncing rod penetrates out of the aircraft body and is configured to receive an external force, and drives a relative movement between the bouncing rod and the aircraft body;

at least one end of the elastic member is connected to the bouncing rod, and the elastic member is configured such that when the bouncing rod is subjected to an external force and moves, the elastic member undergoes elastic deformation and stores elastic potential energy;

the bouncing rod has a rod clamp; and the aircraft body comprises a housing, the housing is provided with an aperture, the rod clamp is larger than the aperture and is located inside the housing, and a portion of the bouncing rod between the rod clamp and the first end passes through the aperture.

2. The hopping-type aircraft interactive toy according to claim 1, wherein the hopping assembly further comprises a limiting member assembled on the aircraft body, and the second end of the bouncing rod is embedded in the limiting member and is slidably connected to the limiting member.

3. The hopping-type aircraft interactive toy according to claim 2, wherein the other end of the elastic member is connected to the limiting member, and the first end of the bouncing rod is configured as a rod seat for receiving an external force.

4. The hopping-type aircraft interactive toy according to claim 3, wherein the elastic member is fixed on the rod clamp.

5. The hopping-type aircraft interactive toy according to claim 2, wherein the elastic member is located inside the limiting member, the at least one end of the elastic member being connected to the second end of the bouncing rod, and the other end of the elastic member being connected inside the limiting member.

6. The hopping-type aircraft interactive toy according to claim 5, wherein the first end of the bouncing rod is configured as a rod seat for receiving an external force.

7. The hopping-type aircraft interactive toy according to claim 1, wherein the aircraft body comprises a housing, a spindle, an electric motor, a first rotor component and a second rotor component, wherein the first rotor component and the second rotor component are respectively installed on the spindle, the center of the first rotor component has an accommodating cavity, the electric motor is installed in the accommodating cavity, and the electric motor is fixedly installed with a cavity wall of the accommodating cavity.

8. The hopping-type aircraft interactive toy according to claim 7, wherein a power supply and a control board are arranged in the accommodating cavity, and the power supply and the control board are respectively electrically connected to the electric motor; and wherein the second rotor component is located below the first rotor component, the spindle is arranged through the second rotor component, and an upper end of the spindle is rotatably installed with the housing.

9. The hopping-type aircraft interactive toy according to claim 1, wherein the aircraft body comprises a housing and a light unit, wherein the housing has a peripheral frame arranged in a ring shape, and the light unit is installed on the peripheral frame for emitting light outward.

10. The hopping-type aircraft interactive toy according to claim 9, wherein the detection assembly comprises a plurality of infrared sensors arranged at intervals along the peripheral frame, and each of the infrared sensors is configured to detect a distance between the housing and an object.

11. The hopping-type aircraft interactive toy according to claim 1, wherein the bouncing rod comprises a rod body and a rod seat, wherein the rod seat is configured as the first end, the elastic member is connected to the rod body, and a cross-sectional area of the rod seat is larger than that of the rod body.

12. A hopping-type aircraft interactive toy, comprising an aircraft body, wherein the aircraft body is equipped with a hopping assembly and a detection assembly, wherein the hopping assembly is elastically deformable to store and release elastic potential energy, and the detection assembly is configured to detect a flight state of the aircraft body, as well as an elastic energy storage state and a potential energy release state of the hopping assembly; and the hopping assembly comprises a bouncing rod and an elastic member, and the bouncing rod has a first end and a second end, wherein the first end of the bouncing rod penetrates out of the aircraft body and is configured to receive an external force, and drives a relative movement between the bouncing rod and the aircraft body; and at least one end of the elastic member is connected to the bouncing rod, and the elastic member is configured such that when the bouncing rod is subjected to an external force and moves, the elastic member undergoes elastic deformation and stores elastic potential energy; and wherein the hopping assembly further comprises a limiting member assembled on the aircraft body, the second end of the bouncing rod extends towards the limiting member and is equipped with a spring retainer, and the spring retainer is movably connected to the limiting member.

13. The hopping-type aircraft interactive toy according to claim 12, wherein one end of the elastic member is connected to the spring retainer, and the other end is connected to the aircraft body; and when the bouncing rod moves axially under an external force, the bouncing rod drives the spring retainer to move axially and causes the elastic member to be in a stretched state.

14. A hopping-type aircraft interactive toy, comprising an aircraft body, wherein the aircraft body is equipped with a hopping assembly and a detection assembly, wherein the hopping assembly is elastically deformable to store and release elastic potential energy, and the detection assembly is configured to detect a flight state of the aircraft body, as well as an elastic energy storage state and a potential energy release state of the hopping assembly; and the hopping assembly comprises a bouncing rod and an elastic member, and the bouncing rod has a first end and a second end, wherein the first end of the bouncing rod penetrates out of the aircraft body and is configured to receive an external force, and drives a relative movement between the bouncing rod and the aircraft body;

at least one end of the elastic member is connected to the bouncing rod, and the elastic member is configured such that when the bouncing rod is subjected to an external force and moves, the elastic member undergoes elastic deformation and stores elastic potential energy;

wherein the aircraft body comprises a housing, a spindle, an electric motor, a first rotor component and a second rotor component, wherein the first rotor component and the second rotor component are respectively installed on the spindle, the center of the first rotor component has an accommodating cavity, the electric motor is installed in the accommodating cavity, and the electric motor is fixedly installed with a cavity wall of the accommodating cavity;

wherein a power supply and a control board are arranged in the accommodating cavity, and the power supply and the control board are respectively electrically connected to the electric motor; and wherein the second rotor component is located below the first rotor component, the spindle is arranged through the second rotor component, and an upper end of the spindle is rotatably installed with the housing; and wherein the hopping assembly further comprises a limiting member assembled on the aircraft body, wherein a lower end of the spindle is embedded in the limiting member, and the limiting member is movably connected to the bouncing rod.

15. The hopping-type aircraft interactive toy according to claim 14, wherein the electric motor drives the second rotor component to rotate through a reduction gear, and the first rotor component is connected to the second rotor component in a linkage manner.

* * * * *